US006050430A

United States Patent [19]

Fleagle et al.

[11] Patent Number: 6,050,430

[45] Date of Patent: Apr. 18, 2000

[54] AUTOMATIC LEVELING AND SYNCHRONIZATION SYSTEM FOR COUNTERWEIGHT REMOVAL AND INSTALLATION

[75] Inventors: Jon Fleagle, Waynesboro, Pa.; David Young, Wilmington, N.C.

[73] Assignee: Grove U.S. L.L.C., Shady Grove, Pa.

[21] Appl. No.: 09/182,464

[22] Filed: Oct. 30, 1998

Related U.S. Application Data

[60] Provisional application No. 60/063,850, Oct. 31, 1997.

[51] Int. Cl.[7] ..... B66C 23/34

[52] U.S. Cl. ..... 212/278; 212/195

[58] Field of Search ..... 414/708; 212/279, 212/178, 196, 197, 278; 91/510

[56] References Cited

U.S. PATENT DOCUMENTS

| | | | |
|---|---|---|---|
| 2,526,613 | 10/1950 | Tanguy . | |
| 2,901,219 | 8/1959 | Bottje et al. . | |
| 3,476,016 | 11/1969 | Dixon et al. | 91/510 |
| 3,734,326 | 5/1973 | Esser . | |
| 3,891,095 | 6/1975 | Symmank . | |
| 3,924,753 | 12/1975 | Lamer et al. . | |
| 4,409,884 | 10/1983 | Boehringer | 91/510 |
| 4,518,305 | 5/1985 | Stuhrmann . | |
| 4,741,413 | 5/1988 | Kishi | 91/510 |
| 4,867,321 | 9/1989 | Montgon | 212/196 |
| 5,110,251 | 5/1992 | Gray | 91/510 |
| 5,199,583 | 4/1993 | Weider et al. . | |
| 5,378,104 | 1/1995 | Payne | 91/510 |
| 5,524,777 | 6/1996 | Weber . | |
| 5,797,310 | 8/1998 | Casey et al. | 91/510 |

*Primary Examiner*—Thomas J. Brahan

[57] ABSTRACT

The automatic leveling and synchronization system for raising and lowering a counterweight includes at least a primary and secondary cylinder connected in series hydraulic communication. The primary cylinder includes a first rod connected to a first piston, and the first rod is attached to one end of a counterweight. The secondary cylinder includes a second rod connected to a second piston, and the second rod is attached to another end of the counterweight. A surface area of a bottom of the second piston is set equal to a surface area of a top of the first piston.

7 Claims, 2 Drawing Sheets

AUTOMATIC LEVELING AND SYNCHRONIZATION SYSTEM FOR COUNTERWEIGHT REMOVAL AND INSTALLATION

This application claims the benefit of US Provisional No. 60/063,850 filed Oct. 31, 1997.

BACKGROUND OF THE INVENTION

1. Field of the Invention

The present invention relates to an automatic leveling and synchronization (ALAS) system for counterweight removal and installation used on cranes to raise and lower a counterweight evenly (counterweight remains level).

2. Description of Related Art

When a single source of supply oil (hydraulic fluid) is divided into two supplies (parallel), the majority (or all) of the total supply will go to the parallel leg that has the least resistance. The remaining supply oil (if any) will go to the other parallel leg. Hydraulic cylinders with equal areas connected in parallel will not necessarily extend or retract evenly due to unusual resistance of (and therefore flow to) each cylinder.

Conventional crane counterweight removal and installation systems use two or more identically sized cylinders in parallel hydraulic communication and connected to opposite ends of a counterweight. These conventional systems use one of two general methods for maintaining uniform or equal cylinder (and therefore counterweight) movement. The first method requires individual control of each cylinder by an operator. In this method the operator insures that the counterweight: remains level (equal cylinder movement) by individually controlling the oil flow to each cylinder. The second method requires the use of hydraulic components to maintain an exact flow of oil to each cylinder to insure that the counterweight remains level. The use of one or a combination of the following components can be used in this type of system: relief valves, flow dividers, flow dividers/combiners, orifices (resistance), and/or pressure compensated flow control valves or other hydraulic components.

First Conventional Method: Individual Control of Identically Sized Cylinders By An Operator Use of this method requires good coordination and judgement on the part of the operator. Due to the possible and probable variances between the control devices for each cylinder, along with the probable uneven loading of each cylinder, the operator has to alter the setting of each control device and judge how level the moving counterweight really is. How level the counterweight is raised and/or lowered will thus vary from one operator to another.

While the control (and control layout) of the main functions of most cranes may be very similar, the operation and control of counterweight removal systems can differ from one crane to another. An experienced operator may be able to move from one crane to another and easily operate the main functions. That same operator, however, may not be familiar with each crane's counterweight removal system, which normally is not used frequently. This situation could result in lost time and/or the counterweight not being raised or lowered properly.

Second Method: Flow To Identically Sized Cylinders Determined By Hydraulic Components An operator using this method of control needs only to select if the counterweight is to be raised or lowered. Hydraulic components control the supply of oil to each cylinder to maintain level counterweight movement when raising or lowering the counterweight. These components can be initially set, at a given temperature and load, to accurately deliver the proper amount of oil to each cylinder. However, slightly out of balance counterweights, differently sized (i.e., weight) counterweights, temperature changes, hydraulic valve springs taking a set (i.e., permanently deformed), component wear-in, change in oil supply (due to pump speed and/or wear), and even an oil change can effectively alter the initial settings. If the initial settings are effectively altered, the counterweight will not maintain a level position while being raised or lowered.

SUMMARY OF THE INVENTION

The system for raising and lowering a counterweight according to the present invention comprises: at least a primary and secondary cylinder connected in series hydraulic communication; the primary cylinder including a first rod connected to a first piston, the first rod for being attached to one end of a counterweight; and the secondary cylinder including a second rod connected to a second piston, the second rod for being attached to another end of the counterweight.

In one embodiment, a surface area of a bottom of the second piston is set equal to a surface area of a top of the first piston.

Objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
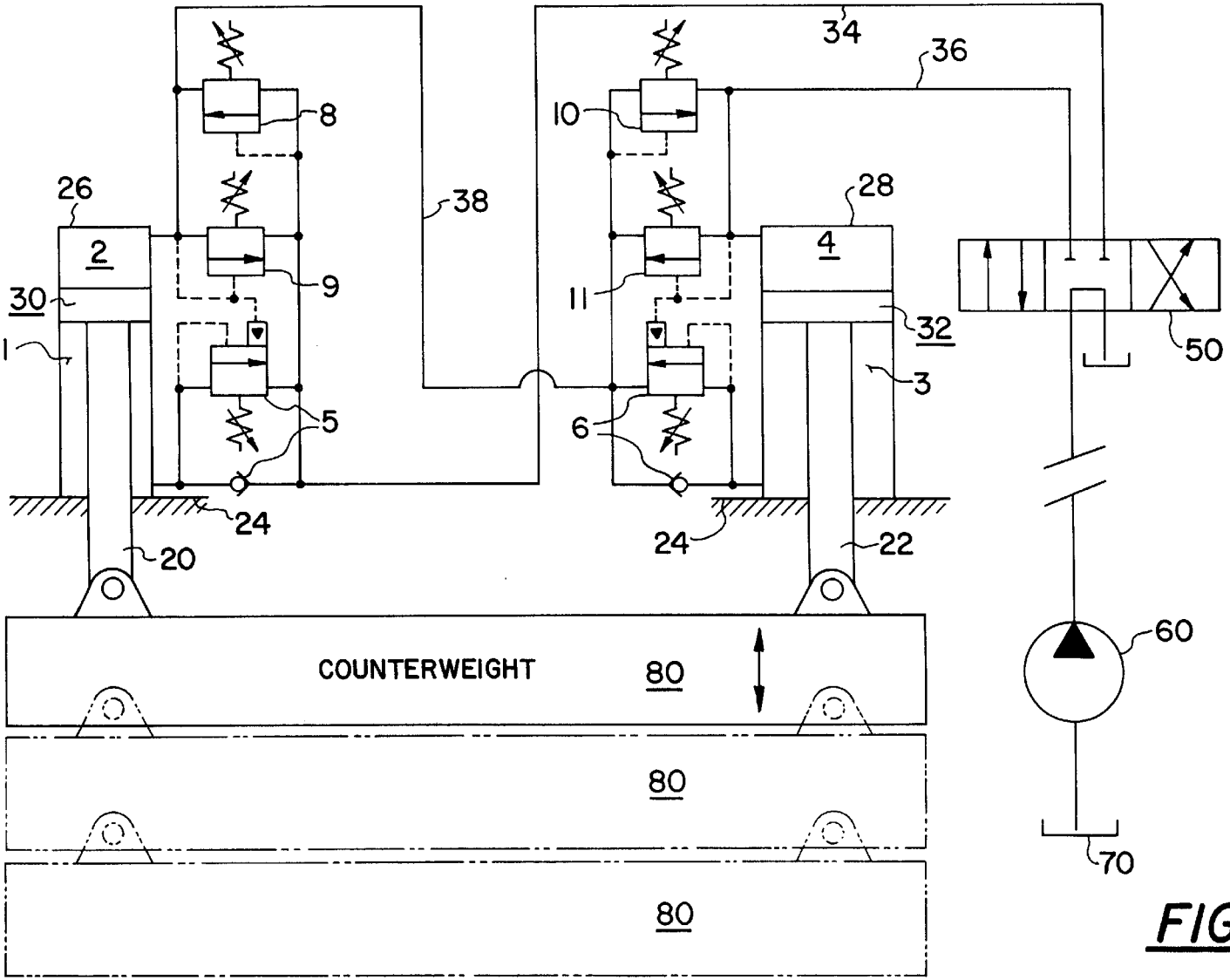
FIG. 1 illustrates the automatic leveling and synchronization system for counterweight removal and installation according to the present invention.
Figure 2A:
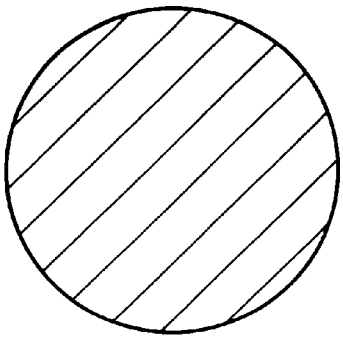
FIGS. 2A illustrates the surface area of the top of the piston in the primary cylinder.
Figure 2B:
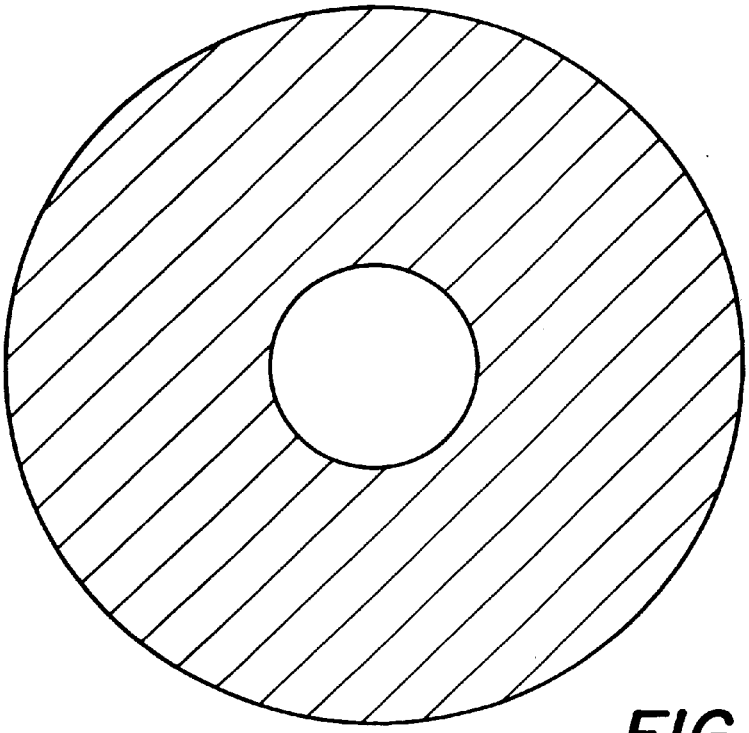
FIGS. 2B illustrates the surface area of the bottom of the piston in the secondary cylinder.

FIG. 1 illustrates the automatic leveling and synchronization system for counterweight removal and installation according to the present invention. As shown in FIG. 1, the system according to the present invention includes at least two hydraulic cylinders, a primary cylinder 26 and a secondary cylinder 28. A first rod 20 of the primary cylinder 26 and a second rod 22 of the secondary cylinder 28 are pinned to opposite ends of a counterweight 80. As shown in phantom lines, the first and second rods 20 and 22 can be connected to a stack of interconnected counterweights 80. The primary cylinder 26 and the secondary cylinder 28 are mounted to the upper structure 24 of a crane (not shown). A first piston head 30 of the first rod 20 divides the primary cylinder 26 into a rod side 1 and a piston side 2. Similarly, a second piston head 32 of the second rod 22 divides the secondary cylinder 28 into a rod side 3 and a piston side 4. The surface area of the top of the first piston 30, shown in FIG. 2A, equals the surface area of the bottom of the second piston 32, shown in FIG. 2B.

A pump 60 supplies hydraulic fluid (i.e., oil) stored in a reservoir 70 to a directional control valve 50. The directional control valve 50 (1) supplies the hydraulic fluid to a first pathway 34 and exhausts hydraulic fluid from a second pathway 36 in a first state, (2) supplies hydraulic fluid to the second pathway 36 and exhausts hydraulic fluid from the first pathway 34 in a second state, or (3) prevents hydraulic fluid from being supplied to or exhausted from either the first or second pathway 34 or 36 in a third state. The directional control valve 50 is under operator control. The operator selects the first state to raise the counterweight 80, and selects the second state to lower the counterweight 80.

As described in detail below, the primary and secondary cylinders 26 and 28 are connected in series between the first and second pathways 34 and 36. A first holding valve 5 connects the first pathway 34 to the rod side 1 of the primary cylinder 26. The first holding valve 5 allows hydraulic fluid to freely pass from the first pathway 34 to the rod side 1 of the primary cylinder 26, and depending upon the pressure in the third pathway 38 and the load (or force) on the first rod 20, allows hydraulic fluid to be exhausted from the rod side 1 of the primary cylinder 26 to the first pathway 34.

The piston side 2 of the primary cylinder 26 is connected to the rod side 3 of the secondary cylinder 28 via the third pathway 38 and the second holding valve 6. The second holding valve 6 allows hydraulic fluid to freely pass from the third pathway 38 to the rod side 3 of the secondary cylinder 28. Depending upon the pressure in the second pathway 36 and the load on the second rod 22, the second holding valve 6 allows hydraulic fluid to be exhausted from the rod side 3 of the secondary cylinder 28 to the third pathway 38. The piston side 4 of the secondary cylinder 28 is connected to the second pathway 36.

A first and second relief valve 8 and 9 are disposed in fluid communication with the first pathway 34, the third pathway 38, and the piston side 2 of the primary cylinder 26. Similarly, third and fourth relief valves 10 and 11 are disposed in fluid communication with the third pathway 38, the second pathway 36, and the piston side 4 of the secondary cylinder 28.

The first relief valve 8 selectively allows hydraulic fluid to flow from the first pathway 34 to the third pathway 38. The second relief valve 9 selectively allows hydraulic fluid to flow from the third pathway 38 to the first pathway 34. The third relief valve 10 selectively is allows hydraulic fluid to flow from the third pathway 38 to the second pathway 36. The fourth relief valve 11 selectively allows hydraulic fluid to flow from the second pathway 36 to the third pathway 38.

Next, the operation of the apparatus for raising and lowering counterweight according to the present invention will be described. To lift the counterweight 80, pressurized oil is supplied to the rod side 1 of the primary cylinder 26 by setting the directional control valve 50 in the first state such that pressurized oil flows through the first pathway 34 and first holding valve 5 to the rod side 1 of the primary cylinder 26. This causes the first rod 20 to retract lifting up one side of the counterweight 80. At the same time, oil is forced from the piston side 2 of the primary cylinder 26. The forced out oil flows through the third pathway 38 and second holding valve 6 to the rod side 3 of the secondary cylinder 28. Consequently, the second rod 22 retracts lifting the other end of the counterweight 80. The retracting second rod 22 forces oil out of the piston side 4 of the secondary cylinder 28, and this forced out oil exhausts via the second pathway 36 and the directional control valve 50.

Because the surface area of the top of the first piston 30 is equal to the surface area of the bottom of the second piston 32, the first and second rods 20 and 22 move the same distance at the same speed and raise the counterweight 80 in a level fashion. Furthermore, since the first rod 20 cannot move unless the secondary cylinder 28 is accepting oil and the second rod 22 cannot move unless being powered by the primary cylinder 26, the first and second rod 20 and 22 will start and stop substantially simultaneously.

To lower the counterweight 80, the directional control valve 50 is placed in the second state. As a result, the pressure of the oil in the second pathway 36 builds up and pilots open the second holding valve 6 such that hydraulic fluid flows out of the rod side 3 of the secondary cylinder 28 into the third pathway 38. This allows pressurized hydraulic fluid to flow into the piston side 4 of the secondary cylinder 28 via the second pathway 36, and causes the second rod 22 to extend and lower one end of the counterweight 80.

The pressure of the oil from the rod side 3 of the secondary cylinder 28 flowing into the third pathway 38 builds up and pilots open the first holding valve 5. As a result, hydraulic fluid flows from the rod side 1 of the primary cylinder 26 to the first pathway 34, and exhausts via the directional control valve 50. This allows the hydraulic fluid in the third pathway 38 to flow into the piston side 2 of the primary cylinder 26, and causes the first rod 20 to extend and lower the other end of the counterweight 80.

Again, because of the equal surface area between the top of the first piston 30 and the bottom of the second piston 32, the first and second rods 20 and 22 will move the same distance at the same speed and the counterweight 80 will lower in a level fashion. Additionally, because the second rod 22 cannot move unless the primary cylinder 26 is accepting hydraulic fluid and the first rod 20 cannot move unless being powered by the secondary cylinder 28, the first and second rods 20 and 22 will start and stop substantially simultaneously.

In the event that the first rod 20 or second rod 22 reaches the fully extended or retracted position before the other, due to imperfect installation or initial setting, the first, second, third, and fourth relief valves 8–11 provide for automatic leveling of the counterweight 80 and synchronization of the primary art secondary cylinders 26 and 28. When raising the counterweight 80, if the second rod 22 reaches the fully retracted position before the first rod 20, oil flow from the piston side 2 of the primary cylinder 26 flows through the third pathway 38, pilots open and flows through the third relief valve 10, and exhausts via the second pathway 36 and the directional control valve 50. Thus, the first rod 20 will fully retract. If the first rod 20 reaches the fully retracted position before the second rod 22, hydraulic fluid in the first pathway 34 pilots open and flows through the first relief valve 8, flows through the third pathway 38 and flows into the rod side 3 of the secondary cylinder 28 via the second holding valve 6. Thus, the second rod 22 will fully retract.

If the second rod 22 reaches the fully extended position before the first rod 20, hydraulic fluid in the second pathway 36 pilots open and flows through the fourth relief valve 11, passes through the third pathway 38, and flows into the piston side 2 of the primary cylinder 26. Thus, the first rod 20 will fully extend. If the first rod 20 reaches the fully extended position before the second rod 22, the hydraulic fluid flowing from the rod side 3 of the secondary cylinder 28 into the third pathway 38 pilots open and flows through the second relief valve 9, and exhausts via the first pathway 34 and the directional control valve 50.

While the present invention has been described as using two cylinders connected in series to raise and lower a counterweight, more than two cylinders connected in series can be used to raise and lower counterweights. Each additional cylinder added in series should have a piston with a bottom surface area equal to the upper surface area of the piston in the previous cylinder. Connecting cylinders of this structure in series will thus allow level and synchronized movement of a counterweight.

Unlike conventional methods and apparatuses for raising and lowering counterweights, the system according to the present invention automatically maintains the counterweight level, and automatically synchronizes the hydraulic cylinders used to raise and lower the counterweight.

The counterweight removal and installation system according to the present invention can be mounted to the upper structure of a crane, the lower structure (i.e., carrier) of a crane, the counterweight itself, or any combination of the above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A system for raising and lowering a counterweight, comprising:

at least a primary and secondary cylinder connected in series hydraulic communication;

said primary cylinder including a first rod connected to a first piston, said first rod for being attached to one end of a counterweight; and said secondary cylinder including a second rod connected to a second piston, said second rod for being attached to another end of said counterweight, a surface area of a bottom of said second piston equal to a surface area of a top of said first piston;

fluid carrying lines for supplying and exhausting hydraulic fluid from said primary and second cylinders and for providing fluid communication between said primary and second cylinders;

regulating valves disposed in said fluid carrying lines for regulating a flow of said hydraulic fluid; and leveling valves, disposed in said fluid carrying lines, permitting said second rod to fully extend if said first rod fully extends prior to said second rod, permitting said first rod to fully extend if said second rod fully extends prior to said first rod, permitting said second rod to fully retract if said first rod fully retracts prior to said second rod, and permitting said first rod to fully retract if said second rod fully retracts prior to said first rod.

2. The system of claim 1, wherein said fluid carrying lines include, a first line connected to a rod side of said primary cylinder, a second line connected between a cylinder side of said primary cylinder and a rod side of said secondary cylinder, and a third line connected to a cylinder side of said secondary cylinder; and said regulating valves include, a first valve disposed in said first line, and a second valve disposed in said second line.

3. The system of claim 2, wherein said first valve is disposed in said first line such that said first line has a primary cylinder side and a non-primary cylinder side, said first valve allows hydraulic fluid to freely flow towards said primary cylinder, and allows said hydraulic fluid to flow away from said primary cylinder when a pressure at said primary cylinder side of said first line is greater than a first predetermined pressure; and a second valve disposed in said second line such that said second line has secondary cylinder side and a non-secondary cylinder side, said second valve allows said hydraulic fluid to freely flow towards said secondary cylinder, and allows said hydraulic fluid to flow away from said secondary cylinder when a pressure at said secondary cylinder side of said second line is greater than a second predetermined pressure.

4. The system of claim 3, further comprising:

a directional control valve supplying said hydraulic fluid to said first line and exhausting said hydraulic fluid from said third line in a first state, and supplying said hydraulic fluid to said third line and exhausting said hydraulic fluid from the first line in a second state.

5. The system of claim 1, wherein said regulating valves regulate the flow of said hydraulic fluid in said fluid carrying lines such that said primary cylinder does not move unless said secondary cylinder moves and said secondary cylinder does not move unless said primary cylinder moves.

6. The system of claim 1, wherein said regulating valves regulate the flow of said hydraulic fluid in said fluid carrying lines such that said primary and secondary cylinders move substantially simultaneously.

7. The system of claim 1, further comprising:

a directional control valve controlling a direction in which said hydraulic fluid flows in said fluid carrying lines.

* * * * *